US010022574B2

(12) United States Patent
McLoughlin

(10) Patent No.: US 10,022,574 B2
(45) Date of Patent: Jul. 17, 2018

(54) NOZZLE POSITIONING DEVICE

(71) Applicant: John E. McLoughlin, Hauppauge, NY (US)

(72) Inventor: John E. McLoughlin, Hauppauge, NY (US)

( * ) Notice: Subject to any disclaimer, the term of this patent is extended or adjusted under 35 U.S.C. 154(b) by 0 days.

(21) Appl. No.: 15/599,202

(22) Filed: May 18, 2017

(65) Prior Publication Data

US 2018/0117378 A1 May 3, 2018

Related U.S. Application Data

(63) Continuation-in-part of application No. 15/338,362, filed on Oct. 29, 2016.

(51) Int. Cl.

| | |
|---|---|
| ***A62C 31/24*** | (2006.01) |
| ***A62C 31/05*** | (2006.01) |
| ***A62C 31/28*** | (2006.01) |
| ***B05B 12/00*** | (2018.01) |

(52) U.S. Cl.

CPC ..... *A62C 31/24* (2013.01); *A62C 31/05* (2013.01); *A62C 31/28* (2013.01); *B05B 12/002* (2013.01)

(58) Field of Classification Search

CPC ..... A62C 31/24; A62C 31/05; A62C 31/28; B05B 12/002; B05B 3/001; B05B 7/16

See application file for complete search history.

(56) References Cited

U.S. PATENT DOCUMENTS

| | | | | | |
|---|---|---|---|---|---|
| 423,663 | A * | 3/1890 | Wiles | A62C 31/24 | 169/25 |
| 1,437,920 | A * | 12/1922 | Stephens | A62B 1/00 | 104/108 |
| 4,781,252 | A * | 11/1988 | Wilburn | A62C 3/06 | 118/306 |
| 4,949,794 | A * | 8/1990 | Petit | A62C 37/08 | 169/25 |
| 6,035,940 | A * | 3/2000 | Bourke | A62C 31/24 | 134/166 R |
| 6,655,613 | B1 * | 12/2003 | Brown | A62C 31/24 | 169/24 |
| 6,811,188 | B2 * | 11/2004 | Haviland | F16L 27/08 | 169/24 |
| 7,114,575 | B2 * | 10/2006 | De Anda-Uribe | A62C 3/06 | 169/24 |
| 7,984,863 | B1 * | 7/2011 | Berberick | A62C 31/24 | 169/47 |
| 2004/0140106 | A1 * | 7/2004 | De Anda-Uribe | A62C 3/06 | 169/66 |

* cited by examiner

*Primary Examiner* — Darren W Gorman
*Assistant Examiner* — Steven M Cernoch
(74) *Attorney, Agent, or Firm* — Louise S. Heim

(57) ABSTRACT

A nozzle positioning includes a primary pole, a grasping element supported on the upper end of the pole and configured to secure the pole to a surface, and a nozzle mount supported on the grasping element. The nozzle mount is configured to support a nozzle in a substantially horizontal position, and may allow the nozzle to rotate and swivel. The grasping element may be in the form of a hook configured to fit over a window ledge or similar structure.

12 Claims, 3 Drawing Sheets

NOZZLE POSITIONING DEVICE

CROSS-REFERENCE TO RELATED TO APPLICATIONS

This application is a continuation-in-part of U.S. non-provisional application Ser. No. 15/338,362, filed Oct. 29, 2016.

TECHNICAL FIELD

This disclosure relates to fire-fighting equipment and, more particularly, to a device for positioning a nozzle in a hard-to-reach location.

BACKGROUND

Firefighters often encounter situations in which it is difficult to deliver water to the main body of a fire. For instance, the stairway in a warehouse or high-rise building may be blocked off, or there may be dangerous substances in the area that prevent firefighters from getting within a certain distance of the fire. Thus, the firefighters must proceed to an adjacent location such as a floor above or below, or a room next to, the main body of the fire, and then extend the nozzle out a window or other opening in the wall, and then attempt to aim the spray from the nozzle into another window or opening in the burn area. The nozzle may be mounted at the end of a positioning device such as generally L-shaped pole having an elongated horizontal portion that a firefighter extends out the first window or opening, and a perpendicularly extending portion that directs the nozzle towards the second window or opening. However, currently available positioning devices can be awkward to handle, and do not allow the nozzle to be accurately aimed. These and other problems are addressed by this disclosure as summarized below.

SUMMARY

A nozzle positioning device according to the present disclosure includes a primary pole, a grasping element supported on the upper end of the pole and configured to secure the pole to a surface, a mounting bracket configured to support a nozzle above the grasping element, and a support element configured to secure the mounting bracket to the grasping element and to allow rotation of the mounting bracket. The grasping element may be in the form of a hook configured to fit over a window ledge or similar structure.

In a preferred embodiment, the primary pole may include a plurality of pole segments detachably coupled in end-to-end relationship with one another. At least one of the pole segments may include handles configured to allow a user to grip and manipulate the pole.

The primary pole may include at least one coupling member configured to allow at least one auxiliary pole to be secured at an acute angle to the primary pole. In a preferred embodiment, two auxiliary poles may be detachably secured to opposite sides of the primary pole. These auxiliary poles allow two secondary users to assist the user who is holding the primary pole.

In one embodiment, the support element comprises a cylindrical body mounted for rotation within a tubular base supported on the grasping element and an intermediate support member mounted for rotation with respect to the cylindrical base member. The mounting bracket may include a front mounting portion configured to support a front portion of the nozzle and a rear mounting portion configured to support a rear portion of the nozzle. A first control wire may be coupled to the front mounting portion, and a second control wire may be coupled to the rear mounting portion.

In an alternate embodiment, the support element comprises an output shaft of a servo motor. When the motor is actuated, the output shaft rotates, causing the support element, mounting bracket, and nozzle to rotate with it.

The device may also include a cooling apparatus configured to cool the grasping apparatus and the nozzle. The cooling apparatus may include a spray bar mounted on the grasping element, wherein the spray bar included a plurality of openings configured to direct water at the grasping element and the nozzle. Water is delivered to the spray bar by a conduit that diverts water from a hose connected to the nozzle. A valve may be provided for controlling flow through the conduit. The valve may be configured to be controlled remotely by a user having a handset.

BRIEF DESCRIPTION OF THE DRAWINGS

The foregoing and more specific objects and advantages of the instant invention will become apparent to those skilled in the art from the following detailed description of the preferred embodiments thereof taken in conjunction with the drawings in which.

DETAILED DESCRIPTION

Figure 1:
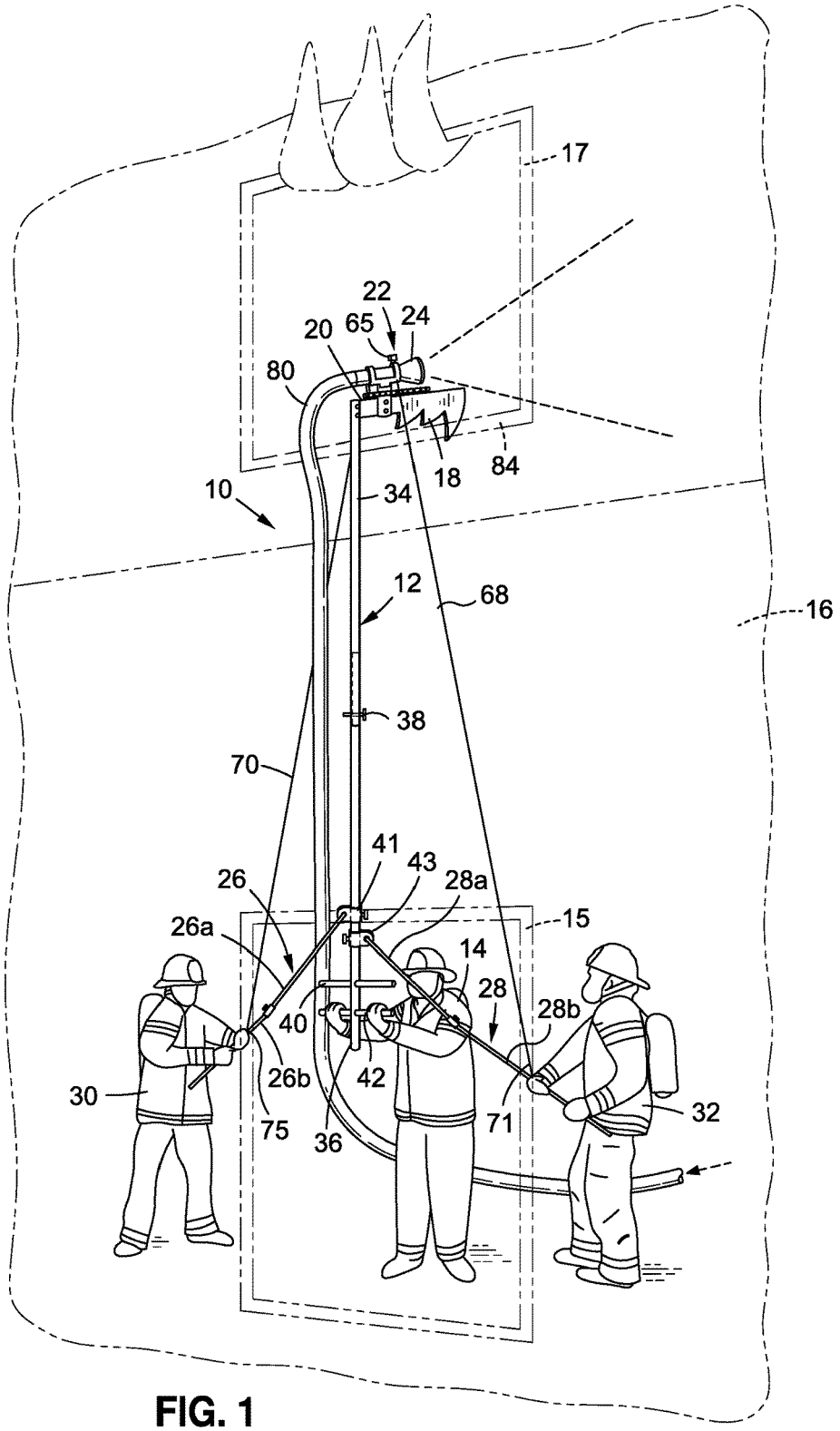
FIG. 1 is a perspective view showing a nozzle positioning apparatus according to the present disclosure being used to position a nozzle in an elevated location.

Turning now to the drawings, which are not necessarily to scale, and wherein some features may be exaggerated or minimized to show details of particular components, FIG. 1 shows a nozzle positioning apparatus 10 including a primary pole 12 that is being held in a vertical position by a firefighter 14 standing at a window 15 of a burning building 16. A grasping element in the form of a hook 18 is secured to the upper end 20 of the primary pole, and a nozzle mount 22 is provided on top of the grasping element 18 for supporting a nozzle 24 in a substantially horizontal position so that it can spray into a second window 17 located a floor above the firefighter 14 and window 15. A pair of auxiliary poles 26, 28 is also provided for allowing additional firefighters 30, 32 to assist the first firefighter 14 in steering the primary pole 12.

The primary pole 12 preferably includes a distal pole segment 34 and a proximal pole segment 36, which are coupled end-to-end with one another by a suitable fastener such as a pin 38 extending through aligned holes in the bottom of the distal pole segment 34 and the top of the proximal pole segment 36. The proximal pole segment 36 may include a set of horizontally extending handles 40, 42 that allow the firefighter 14 to easily grasp and manipulate the pole 12. If a longer pole is needed, one or more additional pole segments may be inserted between distal and proximal segments 34, 36.

Each of the auxiliary poles 26, 28 may comprise distal and proximal pole segments 26*a, b* and 28*a,b* that, like the distal and proximal segments 34, 36 of primary pole 12, are coupled in end-to-end-relationship to one another by a pin extending through aligned holes in the pole segments. The distal end 26*a* of the first auxiliary pole 26 is preferably coupled to a first collar 41 mounted for sliding movement along primary pole 12, and the distal end 28*a* of the second auxiliary pole 28 is preferably coupled to a second collar 43 mounted for sliding movement along primary pole 12.

Figure 2:
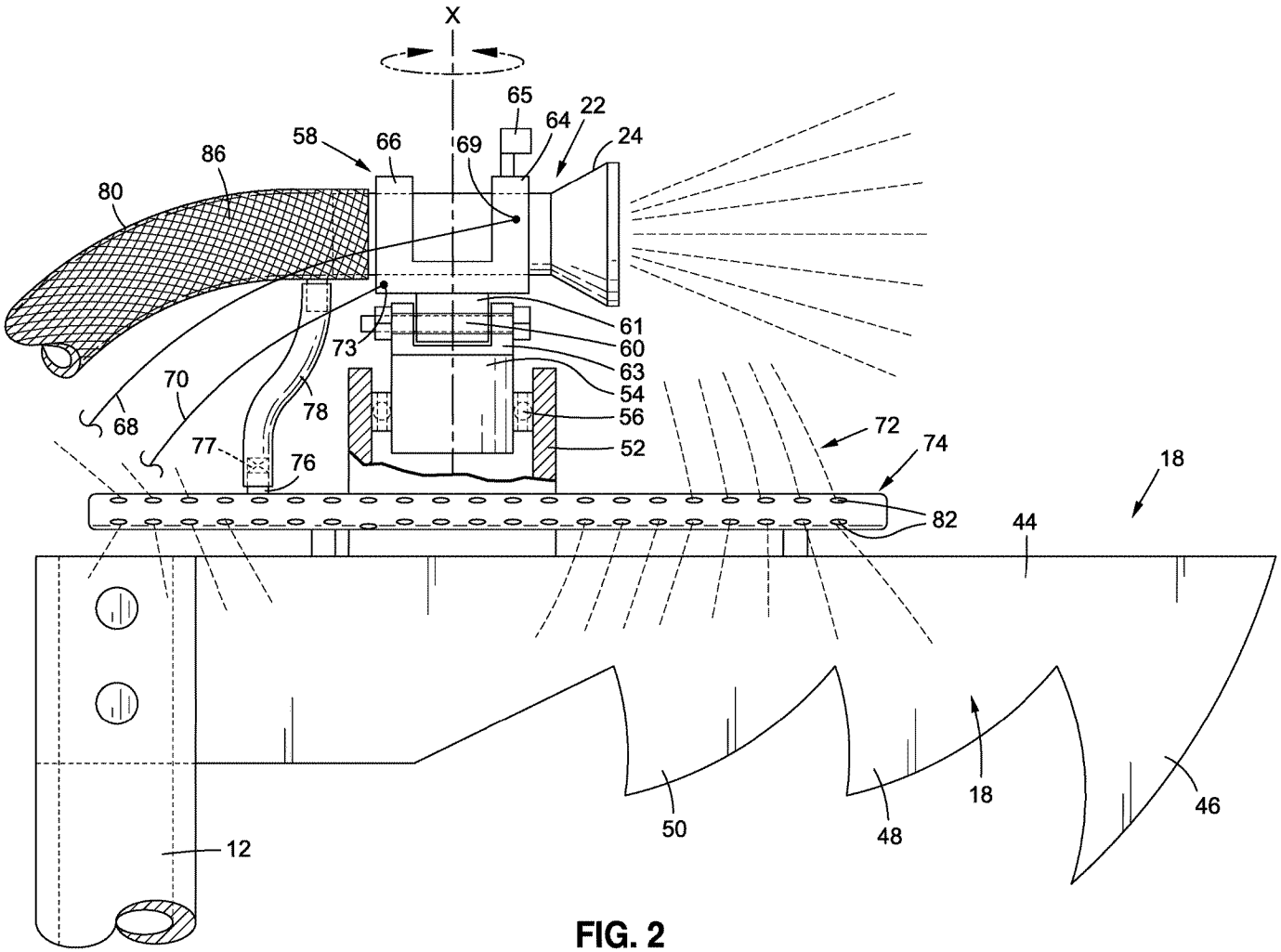
FIG. 2 is a fragmentary side view of the grasping element and nozzle mount of the positioning apparatus of FIG. 1, with a portion broken away to show the interior of the nozzle mount.

Turning now to FIG. 2, grasping element 18 may be similar in configuration to the hook of a conventional pompier ladder. It preferably includes a horizontal portion 44 of sufficient length to extend over a standard-sized window sill or ledge, with a slightly curved vertical hook or tooth 46 formed at its free end. A plurality of additional teeth 48, 50 may also be provided between tooth 46 and pole 12. Other types of hooks or grasping elements configurations may also be suitable.

Nozzle mount 22 includes a cylindrical base member 52 supported on the distal surface of the grasping element 44. An intermediate cylindrical body 54 is mounted for rotation within base member 52 by ball bearings 56. A mounting bracket 58 is coupled to the intermediate support member 54. The connection between the mounting bracket 58 and the intermediate cylindrical body 54 may optionally include a pivot pin 60 that extends through aligned holes in a lower stem 61 of the mounting bracket and a pair of flanges 62, 63 that project upwardly from the intermediate cylindrical body 54. The mounting bracket 58 includes a front mounting portion 64 and a rear mounting portion 66. The front and rear mounting portions 64, 66 may be formed as rings surrounding the front and rear portions of the nozzle 24, or as U-shaped collars, arms, cradles, or similar structures.

In some embodiments, a waterproof camera 65 may be mounted on the nozzle mount 22, or on the nozzle 24. The camera 65, which may be a thermal camera or a video camera, transmits images to a viewing device, which may be in possession of one of the firefighters 14, 30, 32 manipulating the positioning device 10. Alternatively, the camera 65 may transmit the images to a supervisor in a remotely located control center.

The nozzle mount 22 may be rotated about its longitudinal axis X or pivoted about pivot pin 60 by a first control wire 68 having first and second ends 69, 71, and a second control wire 70 having first and second ends 73, 75. The first end 69 of first control wire 68 is secured to front mounting portion 64 of mounting bracket 58, and the first end 73 of second control wire 70 is secured to rear mounting portion 66 of mounting bracket 54. The second end 71, 75 of each control wire 68, 70 is configured to be grasped by a user. To rotate the nozzle to the right, a user would pull first control wire 68 to the right, and to rotate the nozzle to the left, a user would pull second control wire 68 to the left. If a pivotable connection is provided between cylindrical body 54 and mounting bracket 58, a user may tilt the nozzle 24 downwardly by pulling down on first control wire, and may tilt the nozzle 24 upwardly by pulling down on second control wire 70. Alternatively, the pivoting connection could be eliminated, and a user could tilt the nozzle up or down simply by changing the angle of primary pole 12.

Figure 3:
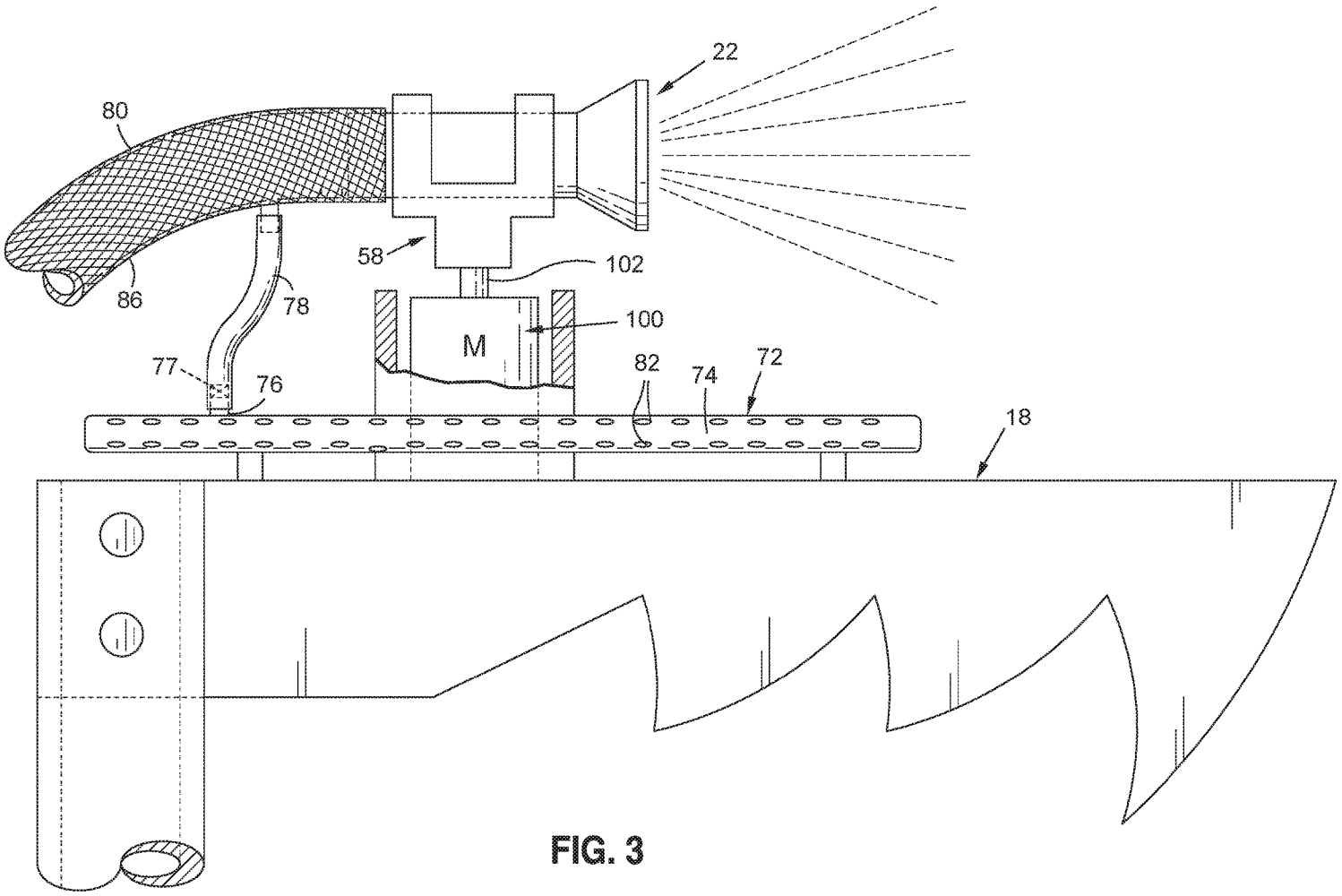
FIG. 3 is a fragmentary side view similar to FIG. 2, showing a nozzle mount according to an alternate embodiment of the invention.

In FIG. 1, the control wires 68, 70 are shown to be held by the two additional firefighters 30, 32. However, both wires could also be held by a single user, such as the primary firefighter 14, or either one of the additional firefighters 30, 32, or anyone else available at the scene. Alternatively, the control wires could be eliminated and the mounting bracket 58 could instead be rotated by a battery-powered servo motor 100 mounted on the upper surface of the grasping element 18, as shown in FIG. 3. In this embodiment, which may otherwise be identical to the embodiment of FIGS. 1 and 2, the output shaft 102 of the servo motor 100 would function as the support element of the nozzle mount. Operation of the servo motor 102 would be operated by one of the firefighters below using a handset or other remote control device. In other embodiments, the servo motor could be replaced by a hydraulic controller, also operated remotely by a firefighter below.

As seen in FIGS. 2 and 3, the device 10 is also provided with a cooling apparatus 72 for preventing the grasping element 18, the nozzle mount 22, and the nozzle 24 from becoming dangerously hot. The cooling apparatus 72 may be in the form of a spray bar 74 mounted above the grasping element 18. More specifically, the spray bar 74 may be a tubular member having an inlet 76 receiving water from a diversion tube 78 coupled to the hose 80 delivering water to nozzle 24. A valve 77, located in the spray bar 74, the diversion tube 78, or the hose 80, controls the flow through the diversion tube 78. The valve 77 may be remotely controlled via a handset operated by the firefighters below.

A plurality of outlet openings 82 in the spray bar 74 are configured to direct water from the spray bar 74 both downwardly toward the grasping element and upwardly toward the nozzle mount 22, the nozzle 24, and the hose 80. In addition to being cooled by spray from the spray bar 72, the portion of the hose 80 nearest the nozzle 24 is protected from heat damage by a heat-resistant woven metal sleeve or cover 86.

To use the device 10 in a burning structure such as a high-rise building, the firefighters mount an empty hose 80 in the device 10 and carry it as high in the building as far as they are safely able to go, for instance, one floor below the body of the fire. In other situations, the firefighters might instead take the device 10 one floor above the body of the fire and extend the primary pole 12 downwardly, or they may be on the same floor as the fire, and extend the primary pole horizontally from a window in a room adjacent to the burn area. Once they reach the desired location, the firefighters extend the primary pole 12 out a window 15 or hole in the wall of the building, and maneuver it upwardly until it reaches another window 16 near the burn area. After securing the hook 18 on a suitable horizontal surface such as a ledge or the sill 84 of the window 16, the first firefighter 14 manipulates the primary pole 22 using handles 40 and 42, while the second and third firefighters 30, 32, assist by manipulating the auxiliary poles 14 and 16. The firefighters may then adjust the direction of the nozzle 22 by pulling on the control wires 68, 70, or by actuating a servo motor or hydraulic controller.

Water should not be supplied to the hose 80 until both the hose 80 and nozzle 20 are properly positioned. However, once water is flowing through the hose 80, the three firefighters working together may make small changes in the position and direction of the hose 80 and the nozzle 22 by manipulating the auxiliary poles 14 and 16, and/or the control strings 68, 70, or by actuating a servo motor or hydraulic controller as needed. For more drastic changes in position, such as moving the nozzle 22 to a different window or opening, the flow should be shut off or reduced until the repositioning is complete.

In some embodiments, the firefighters 14, 30, 32 may use images transmitted from the camera 65 to guide them in manipulating the device, or they may receive audible commands from a supervisor who is viewing the images in a control center.

While the principles of the invention have now been made clear in the illustrated embodiment, there may be immediately obvious to those skilled in the art many modifications of structure, arrangements, proportions, elements, materials and components used in the practice of the invention and otherwise, which are particularly adapted for specific environments and operation requirements without departing from those principles. The appended claims are therefore intended to cover and embrace any such modifications within the limits only of the true spirit and scope of the invention.

What is claimed is:

1. A device for positioning a nozzle coupled to a hose in a hard-to-reach location, comprising:

a primary pole having a distal end and a proximal end;

a grasping element supported on the distal end of the pole and configured to secure the pole to a window sill, the grasping element including a horizontal upper surface extending perpendicular to the primary pole;

a nozzle mount configured to support the nozzle in a horizontal position above and parallel to the horizontal upper surface of the grasping element and to allow the nozzle mount to rotate about a vertical axis extending through the upper surface of the grasping element while the pole is secured to the window sill; and a cooling apparatus configured to cool the grasping element and the nozzle, the cooling apparatus including a spray bar mounted on the grasping element, the spray bar including a plurality of openings configured to direct water at the grasping element, the nozzle, and an exterior surface of the hose proximate the nozzle, and a conduit configured to divert water from the hose to the spray bar.

2. A device according to claim 1, further comprising a valve for controlling flow through the conduit.

3. A device according to claim 2, wherein the valve is remotely controllable.

4. A device according to claim 1, further comprising a heat-resistant mesh provided over an exterior surface of the hose proximate the nozzle.

5. A device according to claim 1, wherein the nozzle mount comprises:

a mounting bracket configured to support the nozzle; and a support element disposed above the horizontal upper surface of the grasping element and configured to secure the mounting bracket to the grasping element and to allow rotation of the mounting bracket about the vertical axis.

6. A device according to claim 5, wherein the support element comprises an output shaft of a servo motor.

7. A device according to claim 5, wherein:

the mounting bracket includes a front mounting portion configured to support a front portion of the nozzle, and a rear mounting portion configured to support a rear portion of the nozzle; and a central stem portion located between the front and rear mounting portions and rotatably supported by the support element.

8. A device for positioning a nozzle coupled to a hose in a hard-to-reach location, comprising:

a primary pole having a distal end and a proximal end;

a grasping element supported on the distal end of the pole and configured to secure the pole to a window sill, the grasping element including a horizontal upper surface extending perpendicular to the primary pole;

a support element disposed on the horizontal surface of the grasping element and defining a vertical axis;

a mounting bracket supported by the support element and configured to hold the nozzle in a horizontal position above and parallel to the horizontal upper surface of the grasping element wherein the mounting bracket is rotatable about the vertical axis; and a cooling apparatus configured to cool the grasping element and the nozzle, the cooling apparatus including a spray bar mounted on the grasping element, the spray bar including a plurality of openings configured to direct water at the grasping element, the nozzle, and an exterior surface of the hose proximate the nozzle; and a conduit configured to divert water from the hose to the spray bar.

9. A device according to claim 8, further comprising a valve for controlling flow through the conduit.

10. A device according to claim 9, wherein the valve is remotely controllable.

11. A device according to claim 8, wherein the support element comprises an output shaft of a servo motor.

12. A device for positioning a nozzle coupled to a hose in a hard-to-reach location, comprising:

a primary pole having a distal end and a proximal end;

a grasping element supported on the distal end of the pole and configured to secure the pole to a surface, the grasping element including a horizontal upper surface extending perpendicular to the primary pole;

a servo motor supported on the horizontal upper surface of the grasping element and including a rotatable output shaft that extends perpendicular to the horizontal upper surface of the grasping element;

a mounting bracket configured to hold the nozzle in a horizontal position above and parallel to the horizontal upper surface of the grasping element, wherein the mounting bracket is supported by and rotatable with the output shaft of the servo motor; and a cooling apparatus configured to cool the grasping element and the nozzle, the cooling apparatus including a spray bar mounted on the grasping element, the spray bar including a plurality of openings configured to direct water at the grasping element, the nozzle, and an exterior surface of the hose proximate the nozzle; and a conduit configured to divert water from the hose to the spray bar.

* * * * *